US012523226B2

(12) United States Patent
Vandevoorde

(10) Patent No.: US 12,523,226 B2
(45) Date of Patent: Jan. 13, 2026

(54) OIL-INJECTED COMPRESSOR DEVICE

(71) Applicant: ATLAS COPCO AIRPOWER, NAAMLOZE VENNOOTSCHAP, Wilrijk (BE)

(72) Inventor: Manuel Paula Albert Vandevoorde, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/724,100

(22) PCT Filed: Dec. 9, 2022

(86) PCT No.: PCT/IB2022/061962
§ 371 (c)(1),
(2) Date: Jun. 25, 2024

(87) PCT Pub. No.: WO2023/144609
PCT Pub. Date: Aug. 3, 2023

(65) Prior Publication Data

US 2025/0067266 A1 Feb. 27, 2025

(30) Foreign Application Priority Data

Jan. 27, 2022 (BE) ..... 2022/5057

(51) Int. Cl.
*F04C 29/02* (2006.01)
*F04B 39/06* (2006.01)

(52) U.S. Cl.
CPC ..... *F04C 29/026* (2013.01); *F04B 39/06* (2013.01)

(58) Field of Classification Search
CPC ..... F04C 18/16; F04C 29/042; F04C 29/026; F04C 29/0014; F04B 39/06; F04B 39/062
(Continued)

(56) References Cited

U.S. PATENT DOCUMENTS 5,803,715 A * 9/1998 Kitchener ..... F04B 39/16 417/313
6,017,205 A * 1/2000 Weatherston ..... F04C 29/02 418/94

(Continued)

FOREIGN PATENT DOCUMENTS

BE 1014461 A3 10/2003
DE 102016011444 A1 3/2018

(Continued)

OTHER PUBLICATIONS

International Search Report of PCT/IB2022/061962 dated Mar. 9, 2023 [PCT/ISA/210].

(Continued)

*Primary Examiner* — Henry Y Liu
(74) *Attorney, Agent, or Firm* — Sughrue Mion, PLLC

(57) ABSTRACT

Oil-injected compressor device (1) provided with at least one oil-injected compressor element (2) with an inlet (5) for gas to be compressed and an outlet (7) for compressed gas, whereby the outlet (7) is connected to an oil separator (9), whereby the oil-injected compressor device (1) is further provided with an oil injection pipe (14) leading from the oil separator (9) to the oil-injected compressor element (2), whereby an oil cooler (15) is incorporated into the oil injection pipe (15), characterized in that a storage (17) for oil is provided in the oil injection pipe (14) downstream of an inlet (16) of the oil cooler (15).

11 Claims, 1 Drawing Sheet

(58) Field of Classification Search
USPC ..... 184/6.16
See application file for complete search history.

(56) References Cited

U.S. PATENT DOCUMENTS

| | | | | |
|---|---|---|---|---|
| 6,604,911 | B2 * | 8/2003 | Pauwels | F04B 49/06 417/313 |
| 7,204,678 | B2 * | 4/2007 | Truyens | F04C 18/16 418/84 |
| 10,550,841 | B2 * | 2/2020 | Kasahara | F04C 18/16 |
| 11,415,342 | B2 * | 8/2022 | Ohnishi | F04C 29/04 |
| 11,428,225 | B2 * | 8/2022 | Okamoto | F04C 29/02 |
| 11,428,226 | B2 * | 8/2022 | Ohnishi | F25B 9/008 |
| 11,994,127 | B2 * | 5/2024 | Okamoto | F01C 21/007 |
| 12,104,596 | B2 * | 10/2024 | Dunn | F04C 23/008 |
| 2002/0157404 | A1 * | 10/2002 | Pauwels | F04B 39/06 62/84 |
| 2005/0089432 | A1 * | 4/2005 | Truyens | F04C 28/06 418/83 |
| 2017/0211891 | A1 * | 7/2017 | Collins | F01C 13/04 |
| 2018/0238329 | A1 * | 8/2018 | Kasahara | F04C 18/16 |
| 2021/0310701 | A1 * | 10/2021 | Okamoto | F04B 25/00 |
| 2021/0310702 | A1 * | 10/2021 | Ohnishi | F25B 40/00 |
| 2021/0310703 | A1 * | 10/2021 | Ohnishi | F01C 21/007 |
| 2021/0340981 | A1 * | 11/2021 | Okamoto | F25B 31/004 |
| 2022/0290670 | A1 * | 9/2022 | Dunn | F04C 18/0207 |

FOREIGN PATENT DOCUMENTS

| | | | |
|---|---|---|---|
| EP | 1156213 | A1 | 11/2001 |
| EP | 1472460 | A1 | 11/2004 |
| JP | 6-341391 | A | 12/1994 |
| JP | 2003-139061 | A | 5/2003 |
| JP | 2005-517125 | A | 6/2005 |
| JP | 2015-48798 | A | 3/2015 |
| WO | 03/067092 | A1 | 8/2003 |

OTHER PUBLICATIONS

Written Opinion of PCT/IB2022/061962 dated Mar. 9, 2023 [PCT/ISA/237].

Communication issued Aug. 4, 2025 in Japanese Application No. 2024-543340.

* cited by examiner

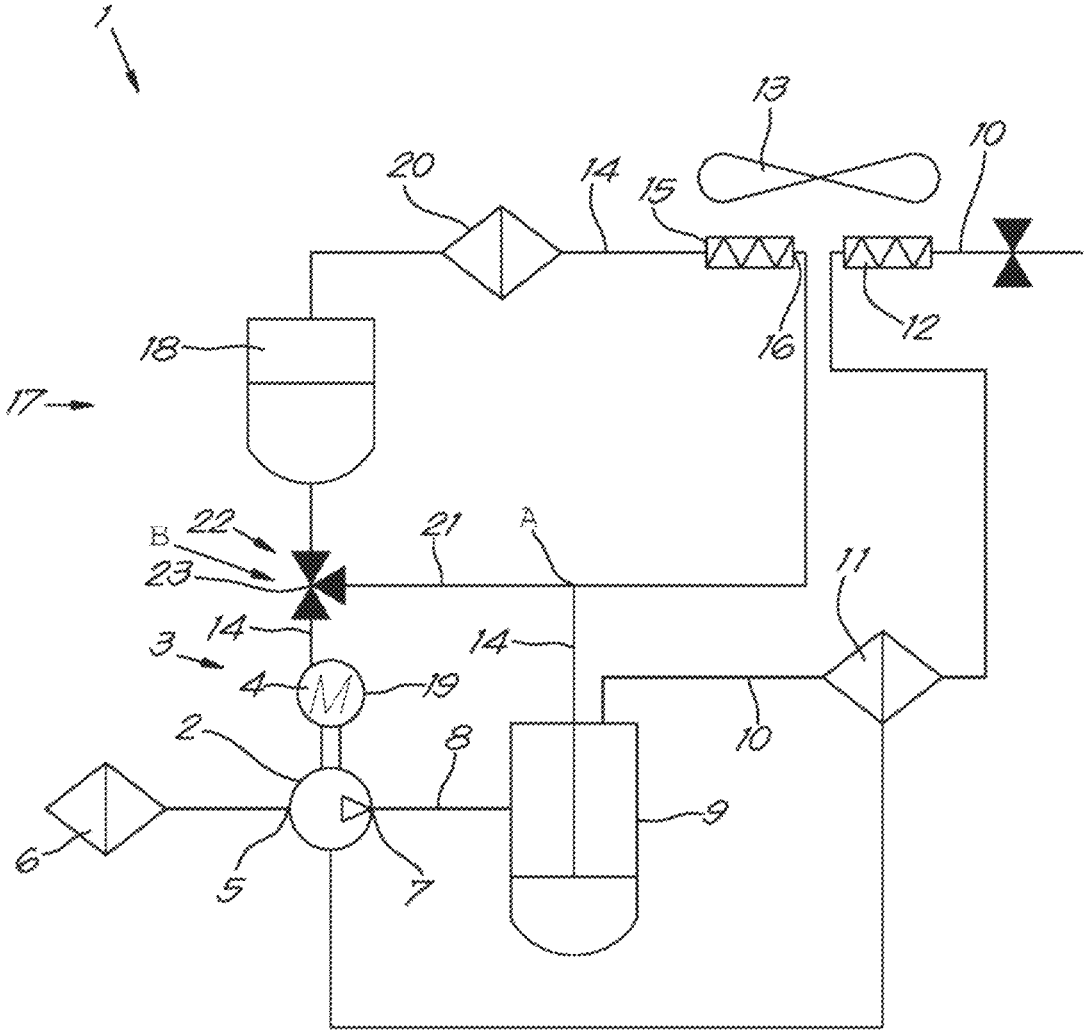
1
13
10
20
14
15
16
12
18
17
B
22
23
21
A
11
3
14
14
4
19
2
8
10
9
6
5
7

OIL-INJECTED COMPRESSOR DEVICE

CROSS REFERENCE TO RELATED APPLICATIONS

This application is a National Stage of International Application No. PCT/IB2022/061962 filed on Dec. 9, 2022, claiming priority based on Belgium Patent Application No. 2022/5057 filed on Jan. 27, 2022.

BACKGROUND OF THE INVENTION

Field

The present invention relates to an oil-injected compressor device.

More specifically, the invention concerns an oil-injected compressor device provided with at least one oil-injected compressor element with an inlet for gas to be compressed and an outlet for compressed gas, whereby the outlet is connected to an oil separator, whereby the oil-injected compressor device is further provided with an oil injection pipe which leads from the oil separator to the oil-injected compressor element, whereby an oil cooler is incorporated into the oil injection pipe.

BACKGROUND

It is known that the oil-injected into the compressor device is separated and stored in the oil separator.

This separated oil will be warm.

Through the oil injection pipe, this oil is routed along the cooler to cool it before injecting this cooled oil into the compressor element.

There are therefore two major disadvantages to such well-known installations.

A first disadvantage is that, due to the fact that the oil is stored in the oil separator, it is necessary to provide a large oil separator.

At start-up, the oil from the oil separator is circulated in the oil injection pipe, the oil cooler and the oil-injected compressor element. Sufficient oil must be available to allow the entire system to be supplied with oil, which requires the oil separator to have a certain minimum volume.

The oil separator is essentially a pressure vessel, which is an expensive component of the device.

In addition, a large oil separator offers less possibilities to compact the device.

An additional disadvantage is that the stored oil in the oil separator comes from the compressor element and is therefore warm or hot. The oil is cooled just before injection, but is thus stored at elevated temperature.

This will affect the service life of the oil.

The service life of the oil is determined by the temperature of this oil. The higher the temperature of the oil becomes or the longer the oil has an elevated temperature, the faster the oil needs to be replaced. The lower the temperature of the oil, the longer the service life.

This will result in additional costs for the replacement of the oil, the associated work, and the standstill of the device.

SUMMARY OF THE INVENTION

The present invention aims to offer a solution for at least one of the above and other disadvantages.

An object of the present invention concerns an oil-injected compressor device provided with at least one oil-injected compressor element with an inlet for gas to be compressed and an outlet for compressed gas, whereby the outlet is connected to an oil separator, whereby the oil-injected compressor device is further provided with an oil injection pipe leading from the oil separator to the oil-injected compressor element, whereby an oil cooler is incorporated into the oil injection pipe, characterized in that a storage for oil is provided in the oil injection pipe downstream of the inlet of the oil cooler.

Storage for oil is a means which allows a temporarily storing of an oil volume.

An advantage is that a certain amount of oil is stored in the oil storage, which means that the oil separator needs to be supplied less oil, which makes it smaller and cheaper.

By storing the oil in the oil storage, it is possible to make the device more compact as there is more freedom in the design of the device so that a more efficient distribution is possible.

Another advantage is that the oil in the oil storage will have cooled down because the oil has passed through the oil cooler before it enters the storage.

As a result, the oil will have a longer service life compared to the known oil-injected compressor devices where the oil is stored at a higher temperature.

Another additional advantage is that the oil in the oil storage for oil is injected more quickly in the compressor device at start-up compared to the oil in the oil separator.

When the known devices start up, all the oil is in the oil separator and must pass through the oil cooler before being injected.

In the device according to the invention, the already cooled oil can be injected immediately from the storage for oil.

Inter alia, the bearings and other components of the device will receive oil much faster for cooling, lubrication and/or sealing.

This has a beneficial effect on the service life of these components and on the performance of the device.

The above-mentioned oil storage can be realized in several ways.

In a practical embodiment, the oil storage comprises one or more of the following:

- an oil vessel incorporated into the oil injection pipe downstream of the oil cooler;
- a portion of the oil injection pipe downstream of the oil cooler has a larger diameter than the rest of the oil injection pipe.

The advantage of the oil vessel is that it should not be a pressure vessel, as it is incorporated into the oil injection pipe as opposed to the oil separator in which also enters the compressed gas, because it is connected to the outlet of the compressor element.

The advantage of the larger diameter section of the oil injection pipe is that a volume for storing the oil is created in this way without increasing the distance that the oil must travel.

This also has the advantage of not having to provide a separate oil vessel, which will make the device more compact.

An alternative practical embodiment is that the oil storage is situated downstream of an inlet of the oil cooler, whereby the storage for oil is included in the oil cooler.

The oil cooler will then function as the oil vessel for the storage for oil.

In this case, the oil cooler is preferably provided with a valve to prevent the return of oil from the storage for oil when the device is stopped.

In another embodiment, the compressor device is provided with a motor to drive the compressor element, whereby the storage for oil is integrated in a shell of the motor.

Such an embodiment makes it possible to obtain a very compact device, since the engine shell will serve as storage for oil, which means that no separate oil vessel must be provided.

At start-up, the oil can also be injected directly into the motor and the compressor element.

BRIEF DESCRIPTION OF THE DRAWINGS

With the insight of better indicating the characteristics of the invention, in the following are described, as an example without any restriction, some of the preferred embodiments of an oil-injected compressor device according to the invention, with reference to the accompanying drawings, in which:

The FIGURE schematically represents an oil-injected compressor device according to the invention.

DETAILED DESCRIPTION OF THE INVENTION

The oil-injected compressor device 1 schematically shown in the FIGURE mainly comprises an oil-injected compressor element 2.

For example, this compressor element 2 may be a screw compressor element, but other types of compressor elements 2 are not excluded.

Moreover, it is not excluded that the compressor device 1 is provided with more than one compressor element 2.

The compressor element 2 is provided with a drive 3. The FIGURE schematically shows the drive 3 in the form of a motor 4.

The compressor element 2 has an inlet 5 for gas to be compressed.

In this case, an inlet filter 6 is connected to this inlet 5 in order to purify the gas which has been drawn.

The compressor element 2 also has an outlet 7 for the compressed gas.

On this outlet 7, a discharge pipe 8 is connected to link the outlet 7 to an oil separator 9.

In this case, an outlet pipe 10 is connected to the oil separator 9 for compressed gas, whereby a second oil separator 11 and an aftercooler 12 are incorporated into the outlet pipe 10.

In this case, the aftercooler 12 is air-cooled by a fan 13.

The compressor device 1 is also provided with an oil injection pipe 14 which leads from oil separator 9 to the compressor element 2.

An oil cooler 15 is incorporated into this oil injection pipe 14.

In this case, this oil cooler 15 is an air-cooled cooler, whereby the aforementioned fan 13 will also cool the oil cooler 15.

It is not excluded that instead of providing one common fan 13 for the aftercooler 12 and the oil cooler 15, one common fan device is provided, or separate fans or fan assemblies are provided.

According to the invention, a storage 17 for oil is provided downstream of the inlet 16 of the oil cooler 15.

This storage 17 for oil can be realized in diverse ways, as mentioned above.

In the example shown in the FIGURE, the storage 17 for oil comprises an oil vessel 18 which is incorporated into the oil injection pipe 14 downstream of the oil cooler.

Of course, it is not excluded that the storage 17 for oil is realized in another way:

- a section of the oil injection pipe 14 downstream of the oil cooler 15 has a larger diameter than the rest of the oil injection pipe 14;
- integrated in the oil cooler 15;
- integrated in the shell 19 of the above-mentioned engine 4.

In the example shown, immediately upstream of the storage 17 for oil, i.e., the oil vessel 18, an oil filter 20 is provided in the oil injection pipe 14.

It is not excluded that more than one oil filter 20 is provided.

In addition, these one or more oil filters 20 can also be provided downstream of the storage 17 for oil.

In this case, but not necessary for the invention, the oil cooler 15 and the storage 17 for oil can be bypassed via a bypass line 21.

This bypass line 21 runs from a point A in the oil injection pipe 14 upstream of the oil cooler 15 to a point B in the oil injection pipe 14 downstream of the storage 17 for oil.

Control means 22 are also provided in the form of a three-way valve 23 to be able to control the amount of oil going through the bypass line 21.

Instead of a three-way valve 23, the control means 22 can also comprise a thermostat and/or a combination of one or more valves.

In the FIGURE, the control means 22 are provided at a point in the injection pipe 14 downstream of the storage 17 for oil, i.e., in the aforementioned point B, but this could also be upstream of the oil cooler 15, i.e., in the aforementioned point A.

The operation of the compressor device 1 is quite simple and as follows.

During the operation of the compressor device 1, gas to be compressed is drawn through the inlet 5. This gas passes through the inlet filter 6 to remove impurities.

In the compressor element 2, the gas is compressed.

The motor 4 will drive the compressor element 2, whereby oil will be injected into the compressor element 2 and the motor 4.

The compressed gas and the injected oil will leave the compressor element 2 through the outlet 7 and pass through the discharge pipe 8 into the oil separator 9.

During the compression, gas and oil will heat up.

In the oil separator 9, the compressed gas is separated from the oil; thereafter the gas will pass through the outlet pipe 10 along the second oil separator 11. Herewith the last oil is still separated. In this case, the oil separated in the second oil separator 11 is injected into the compressor element 2.

Then the compressed gas passes through the aftercooler 12, so that the gas will be cooled before leaving the compressor device 1.

The oil separated in the oil separator 9 is brought to the oil cooler 15 by the pressure of the compressed gas in the oil separator 9 via the injection pipe 14, or injected directly back into the compressor element 2 via the bypass line 21.

In the oil cooler 15, the oil is cooled to then enter the storage 17 for oil.

Hereby the oil will pass through the oil filter 20 first, so that eventually cooled and purified oil will enter the storage 17 for oil.

The oil remains in the storage 17 for oil until the control means 22 are opened to inject oil from the storage 17 for oil.

The control means 22 will determine how much of the still hot oil is injected through the bypass line 21 and how much of the cooled oil is injected from the oil vessel 18.

These control means 22 will allow the temperature of the oil being injected to be controlled.

A control device or similar can be provided for the management of these control means 22.

Since in the case of the invention, the oil separator 9 is smaller than in the known devices, it will store less oil and a major part of the oil will be cooled and stored in the oil vessel 18.

In addition, on start-up, oil from the oil vessel 18 can be immediately injected to bearings and other components of the compressor element 2.

The present invention is by no means limited to the embodiments described as examples and presented in the FIGURE, but an oil-injected compressor device according to the invention can be realized in all kinds of shapes and sizes without leaving the scope of the invention.

The invention claimed is:

1. An oil-injected compressor device provided with at least one oil-injected compressor element with an inlet for gas to be compressed and an outlet for compressed gas, whereby the outlet is connected to an oil separator, whereby the oil-injected compressor device is also provided with an oil injection pipe which leads from the oil separator to the at least one oil-injected compressor element, whereby an oil cooler is incorporated into the oil injection pipe, characterized in that a storage for oil is provided in the oil injection pipe downstream of an inlet of the oil cooler.

2. The oil-injected compressor device according to claim 1, characterized in that the storage for oil comprises one or more of the following:

an oil vessel incorporated in the oil injection pipe downstream of the oil cooler;

a section of the oil injection pipe downstream of the oil cooler has a larger diameter than the rest of the oil injection pipe.

3. The oil-injected compressor device according to claim 1, characterized in that the storage for oil is situated downstream of the inlet of the oil cooler inlet, whereby the storage for oil is incorporated in the oil cooler.

4. The oil-injected compressor device according to claim 1, characterized in that the compressor device is provided with a motor to drive the at least one oil-injected compressor element, whereby the storage for oil is integrated into a shell of the motor.

5. The oil-injected compressor device according to claim 1, characterized in that the compressor device is provided with a bypass line running from a point (A) in the oil injection pipe upstream of the oil cooler to a point (B) in the oil injection pipe downstream of the storage to allow oil to bypass the oil cooler and the storage through the bypass line, whereby control means are provided to be able to control an amount of oil going through the bypass line.

6. The oil-injected compressor device according to claim 5, characterized in that the control means are a three-way valve, a thermostat and/or a combination of one or more valves.

7. The oil-injected compressor device according to claim 5, characterized in that the control means upstream of the oil cooler or downstream of the storage for oil are incorporated into the oil injection pipe.

8. The oil-injected compressor device according to claim 1, characterized in that an outlet pipe is connected to the oil separator, whereby an aftercooler is incorporated into the outlet pipe.

9. The oil-injected compressor device according to claim 8, characterized in that a second oil separator is incorporated in the outlet pipe.

10. The oil-injected compressor device according to claim 8, characterized in that the aftercooler and the oil cooler are air-cooled coolers, whereby one common fan or a fan group is provided for the aftercooler and the oil cooler.

11. The oil-injected compressor device according to claim 1, characterized in that one or more oil filters are incorporated in the oil injection pipe immediately upstream or downstream of the storage for oil.

* * * * *